US006865353B2

(12) United States Patent
Fujita et al.

(10) Patent No.: US 6,865,353 B2
(45) Date of Patent: Mar. 8, 2005

(54) IMAGE FORMING APPARATUS WITH AN ADJUSTABLE, LOCKABLE OPERATING SURFACE

(75) Inventors: Atsushi Fujita, Tokyo (JP); Yoshihiro Hata, Tokyo (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/442,878

(22) Filed: May 21, 2003

(65) Prior Publication Data

US 2003/0219273 A1 Nov. 27, 2003

(30) Foreign Application Priority Data

May 27, 2002 (JP) ..... 2002-152307

(51) Int. Cl.[7] ..... G03G 15/00
(52) U.S. Cl. ..... 399/81
(58) Field of Search ..... 248/917, 919, 248/920, 922, 923; 399/75, 81, 107; 361/681

(56) References Cited

U.S. PATENT DOCUMENTS 4,251,850 A * 2/1981 Kalbitz et al. ..... 361/681
5,589,849 A * 12/1996 Ditzik ..... 361/681
5,668,570 A * 9/1997 Ditzik ..... 248/923 X
5,870,647 A * 2/1999 Nada et al. ..... 399/107 X
6,654,068 B1 * 11/2003 Brewington et al. .... 361/681 X

* cited by examiner

*Primary Examiner*—Sandra L. Brase
(74) *Attorney, Agent, or Firm*—Muserlian, Lucas and Mercanti

(57) ABSTRACT

This invention relates to an image forming apparatus having, on the upper surface of an apparatus main body, an operating section which is divided into an operating surface unit in which the angle of an operating surface with respect to a horizontal plane can be changed, and an operating section external unit formed outside the operating surface unit and including at least an upper-surface corner end of the apparatus main body. The apparatus includes an angle holding member for holding the angle of the operating surface with respect to the horizontal plane, a plurality of locking portions formed on the apparatus main body, and a plurality of locking target portions which are formed on the angle holding member and the operating surface unit and which can respectively be locked by the plurality of locking portions. Either the locking target portion provided to the angle holding member or the locking target portion provided to the operating surface unit is selectively locked by the locking portion of the apparatus main body in order to support the operating surface unit with the apparatus main body such that the operating surface of the operating surface unit is held at a plurality of angles with respect to the horizontal plane.

15 Claims, 7 Drawing Sheets

IMAGE FORMING APPARATUS WITH AN ADJUSTABLE, LOCKABLE OPERATING SURFACE

BACKGROUND OF THE INVENTION

1. Field of the Invention

The present invention relates to an image forming apparatus and, more particularly, to an image forming apparatus in which the angle of the operating section to the horizontal plane can be changed.

2. Description of the Related Art

FIG. 1 is a perspective view of a copying machine as an example of an image forming apparatus. A copying machine 1 has an operating section 3 and an ADF 2 capable of automatically feeding a document on the apparatus. A plurality of documents are placed on the ADF 2, and image forming conditions are input from the operating section 3. The operating section 3 is formed of a liquid crystal panel 3*a* and an input portion 3*b* having ten keys, a start button, and the like. The liquid crystal panel 3*a* displays the current state of the copying machine 1. The image forming conditions such as the number of copies, the copy density, copy magnification, and the like are set from the input portion 3*b*.

When the start button at the input portion 3*b* is pressed, the documents are read from the ADF 2 one by one, and copying is started. The copy sheet is supplied from one of a plurality of trays 4*a* to 4*c*, and a copy sheet on which an image is copied is delivered to a delivery section 5. The detailed operation in the copying machine 1 is not directly related to the present invention and is accordingly omitted.

As the operator stands in front of the copying machine 1, he or she looks down the operating section 3 from its oblique front. The height of the operating section 3 is almost equal to the height of the waist of the operator. If the operating section 3 is horizontal, it is oblique from the operator, and he cannot see it easily. In view of this, conventionally, the operating section 3 forms a moderate downward slope toward the front end of the image forming apparatus, so that an angle $\alpha$ of the operating section 3 with respect to a horizontal plane H becomes about 7°. When a light slope is formed in this manner, the liquid crystal panel 3*a* can be seen easily and the input portion 3*b* can be operated easily.

Recently, universal design, or "to design products, buildings, and spaces such that as many as possible people can use them", has been proposed. It is important that an image forming apparatus also be universally designed so a handicapped can use it easily.

The above operating section 3 is based on the assumption that the operator is a non-handicapped person. A handicapped person in a wheelchair cannot see the operating section 3 easily partly because its height is close to his eye level.

It is therefore desired that the angle (the angle a in FIG. 1) of the operating section 3 be increased for the sake of the handicapped person. To meet this demand, the operating section 3 may be designed such that its angle can be changed. More specifically, the entire operating section 3 may be formed pivotal.

The operating section 3, however, is at the front end face of the image forming apparatus. When relocating the image forming apparatus, it is done so by placing hands to the two ends of the operating section 3 and applying a large force to it. If the operating section 3 is pivotal, its strength is difficult to secure. The operating section 3 may not be able to stand the force applied to it during relocation, and may be damaged.

SUMMARY OF THE INVENTION

The present invention has been made in view of the above situation, and has as its object to provide an image forming apparatus which is universally designed so that its operating section is pivotal while securing its strength.

In order to achieve the above object, according to the first aspect of the present invention, there is provided an image forming apparatus having, on an upper surface of an apparatus main body, an operating section which can be divided into an operating surface unit in which an angle of an operating surface with respect to a horizontal plane can be changed, and an operating section external unit formed outside the operating surface unit and including at least an upper-surface corner end of the apparatus main body, comprising an angle holding member for holding the angle of the operating surface with respect to the horizontal plane, a plurality of locking portions formed on the apparatus main body, and a plurality of locking target portions which are formed on the angle holding member and the operating surface unit and which can respectively be locked by the plurality of locking portions, wherein either the locking target portion provided to the angle holding member or the locking target portion provided to the operating surface unit is selectively locked by the locking portion of the apparatus main body in order to support the operating surface unit with the apparatus main body such that the operating surface of the operating surface unit is held at a plurality of angles with respect to the horizontal plane.

According to the second aspect of the present invention, there is provided an image forming apparatus wherein the angle holding member according to the first aspect serves as a cover for covering a gap between the apparatus main body and the operating surface unit, and is detachably provided to the apparatus main body.

According to the third aspect of the present invention, there is provided an image forming apparatus according to the first or second aspect, wherein engagement of the locking portions and the locking target portions according to the first aspect is an arrangement of threadably engaging a machine screw in a female screw hole, and the machine screw can be mounted and detached through a front surface of the apparatus main body.

According to the fourth aspect of the present invention, there is provided an image forming apparatus according to any one of the first to third aspects, wherein a sealing member formed of an elastic member is adhered between the operating surface unit and the operating section external unit both according to the first aspect.

According to the fifth aspect of the present invention, there is provided an image forming apparatus according to any one of the first to fourth aspects, wherein when a height from a floor surface to the operating surface of the operating surface unit is 900 mm to 1,100 mm, an angle of the operating surface with respect to the horizontal plane according to the first aspect is 5° to 10°.

According to the sixth aspect of the present invention, there is provided an image forming apparatus according to any one of the first to fourth aspects, wherein when a height from a floor surface to the operating surface of the operating surface unit is 900 mm to 1,100 mm, an angle of the operating surface with respect to the horizontal plane according to the first aspect is 10° to 18°.

As is apparent from the above aspects, according to the present invention, there is provided an image forming apparatus which is universally designed so its operating section is pivotal and which is not easily damaged during relocation or the like.

The engagement of the locking portions and locking target portions includes an arrangement of threadably engaging a machine screw in a female screw hole, and the machine screw can be mounted and detached through the front surface of the apparatus main body. Thus, the angle holding member can be mounted and removed easily, and the angle of the operating surface unit can be changed easily.

A sealing member formed of an elastic member is adhered between the operating surface unit and the operating section external unit. Thus, no gap is formed between the operating surface unit and the operating section external unit, preventing any small substance from dropping in the gap.

The above and many other objects, features and advantages of the present invention will become manifest to those skilled in the art upon making reference to the following detailed description and accompanying drawings in which a preferred embodiment incorporating the principle of the present invention is shown by way of illustrative examples.

BRIEF DESCRIPTION OF THE DRAWINGS

FIGS. 6A and 6B are both enlarged sectional views taken along the line A—A of FIG. 3, in which FIG. 6A shows a state wherein the operating surface unit is on the upper side and FIG. 6B shows a state wherein it is on the lower side;

FIGS. 7A and 7B are both views showing the end of the operating surface unit, in which FIG. 7A shows a state wherein the operating surface unit is on the upper side and FIG. 7B shows a state wherein it is on the lower side;

DETAILED DESCRIPTION OF THE PREFERRED EMBODIMENT

A preferred embodiment of the present invention will be described with reference to the accompanying drawings.

Figure 2:
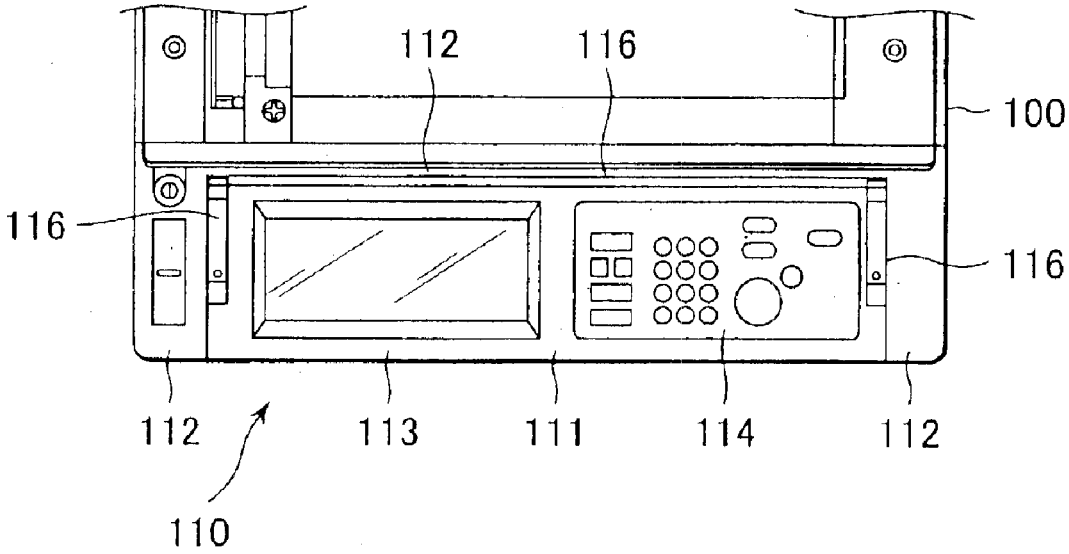
FIG. 2 is a plan view showing the operating section and its vicinity of an image forming apparatus of the present invention.
Figure 3:
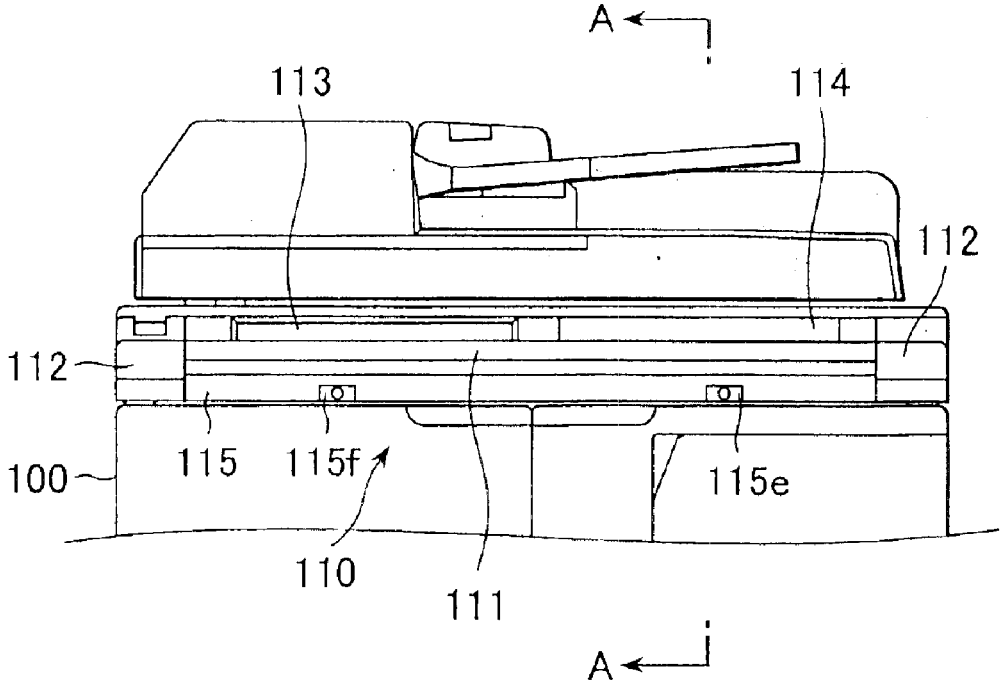
FIG. 3 is a front view showing the operating section and its vicinity of the image forming apparatus of the present invention.

As shown in FIGS. 2 and 3, an apparatus main body 100 of the image forming apparatus has an operating section 110 at the front end of its upper surface. The operating section 110 is divided into an operating surface unit 111 in which the angle of the operating surface can be changed, and an operating section external unit 112 surrounding the operating surface unit 111 from three directions, i.e., the right and left sides and the rear side. The operating surface unit 111 has a display 113 formed of a liquid crystal panel, and an input portion 114 formed of ten keys and start button. The operating section external unit 112 is fixed to the apparatus main body 100. As shown in FIG. 3, under the operating surface unit 111, an angle holding member 115 is inserted between it and the apparatus main body 100.

Figure 4:
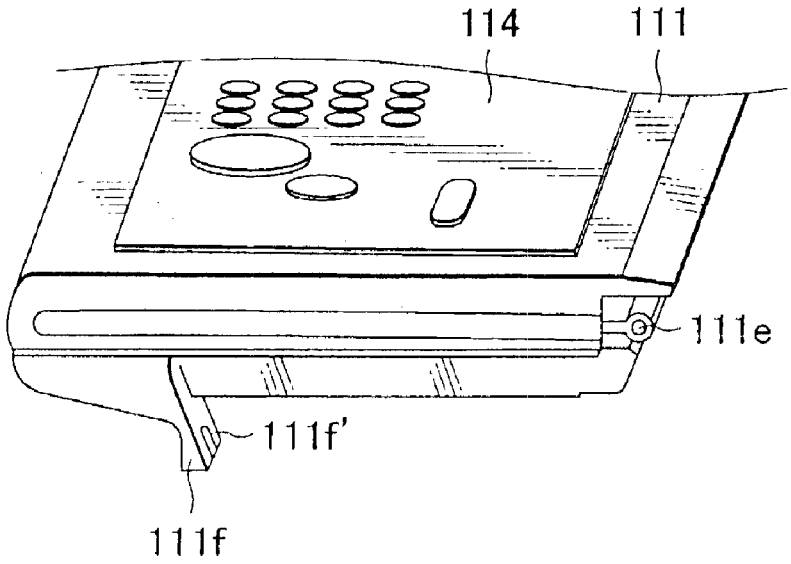
FIG. 4 is a perspective view showing the end of an operating surface unit.
Figure 5:
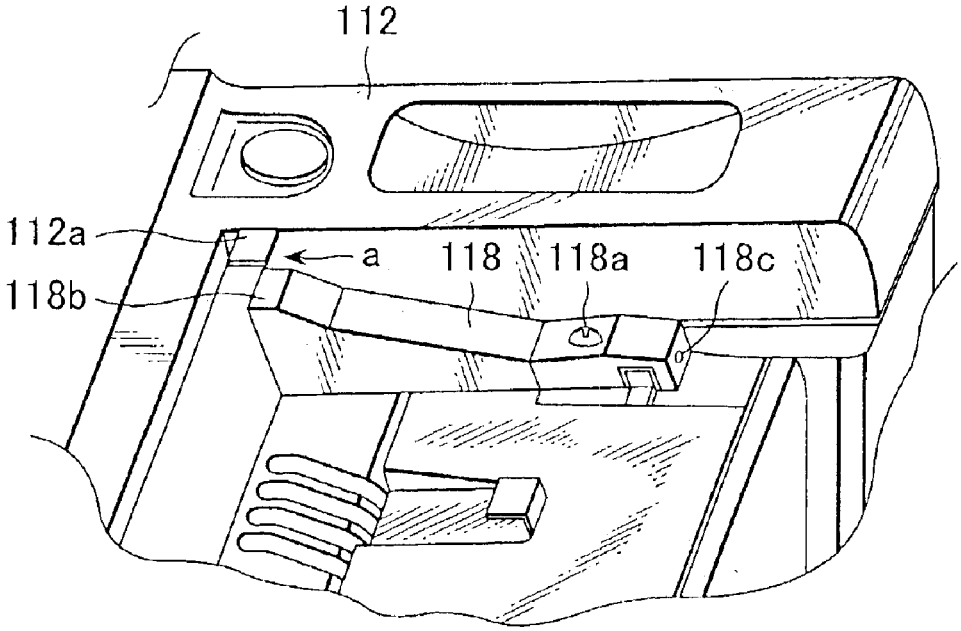
FIG. 5 is a perspective view showing the main part of the main body to which the end of the operating surface unit is to be attached.

As is apparent from FIGS. 4 and 5, the operating section external unit 112 has support brackets 118 at its two ends, which are fixed to the apparatus main body 100 with machine screws 118*a*. The operating section external unit 112 has square plate-like projections 112*a* at its corners, which extend like eaves beyond upper-surface proximal ends 118*b* of the support brackets 118.

As shown in FIG. 4, the operating surface unit 111 has circular columnar pins 111*e* at its two ends, which are inserted between the plate-like projections 112*a* and the upper-surface proximal ends 118*b* of the support brackets 118 fixed to the two ends of the operating section external unit 112, from a direction of an arrow a of FIG. 4. Thus, the operating surface unit 111 is pivotally supported by the apparatus main body 100. Fixing projections 111*f* having screw grooves with open distal ends stand vertically from that lower surface of the operating surface unit 111 which is in front of the pins 111*e*. The fixing projections 111*f* have screw holes 111*f'* at their distal ends. When the operating surface unit 111 is mounted at a predetermined position, the screw holes 111*f'* and female screw holes 118*c* formed in the distal end faces of the support brackets 118 coincide with each other, so they can be threadably attached to each other with machine screws.

Figure 1:
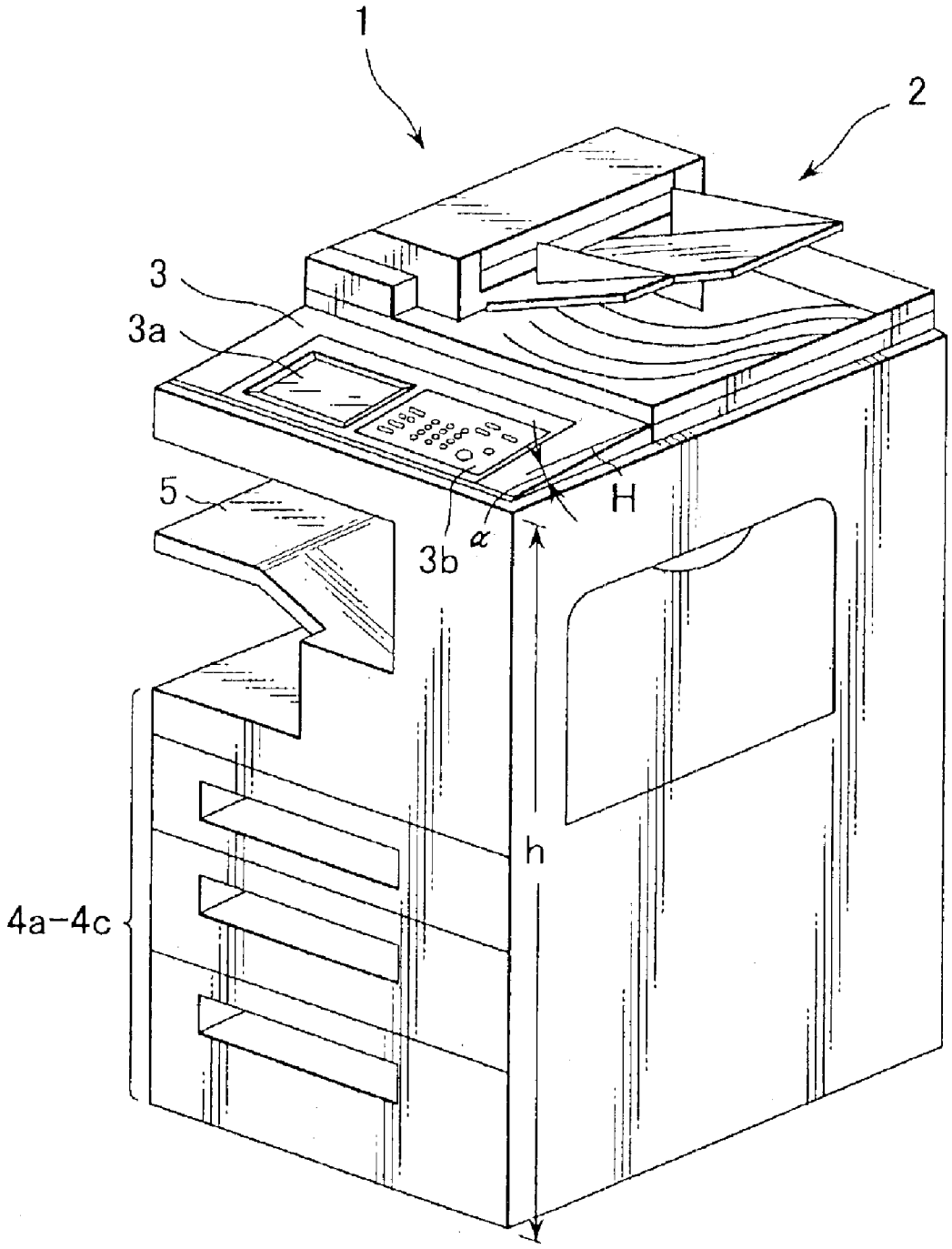
FIG. 1 is a perspective view of a copying machine as an example of an image forming apparatus.
Figure 6A:
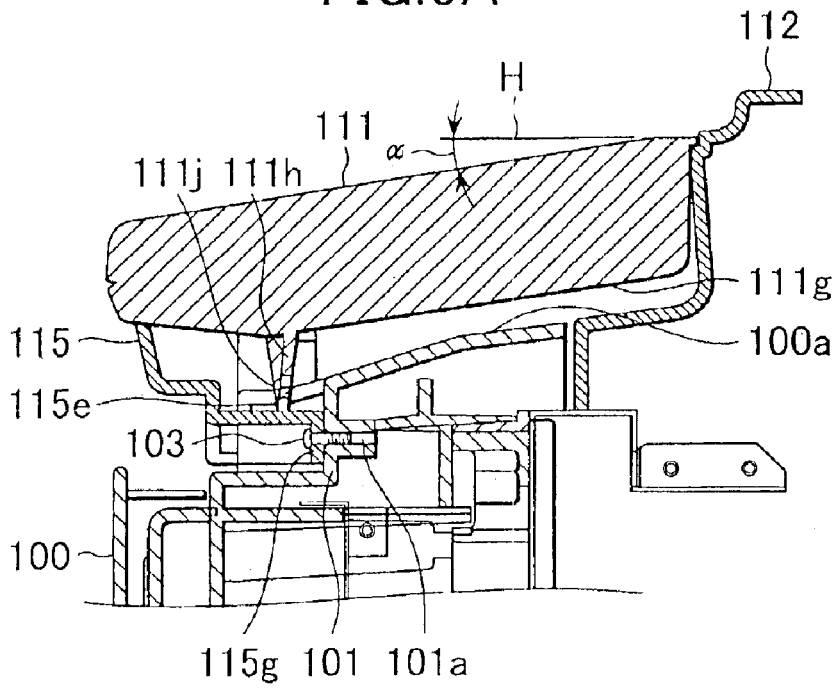
Figure 7A:
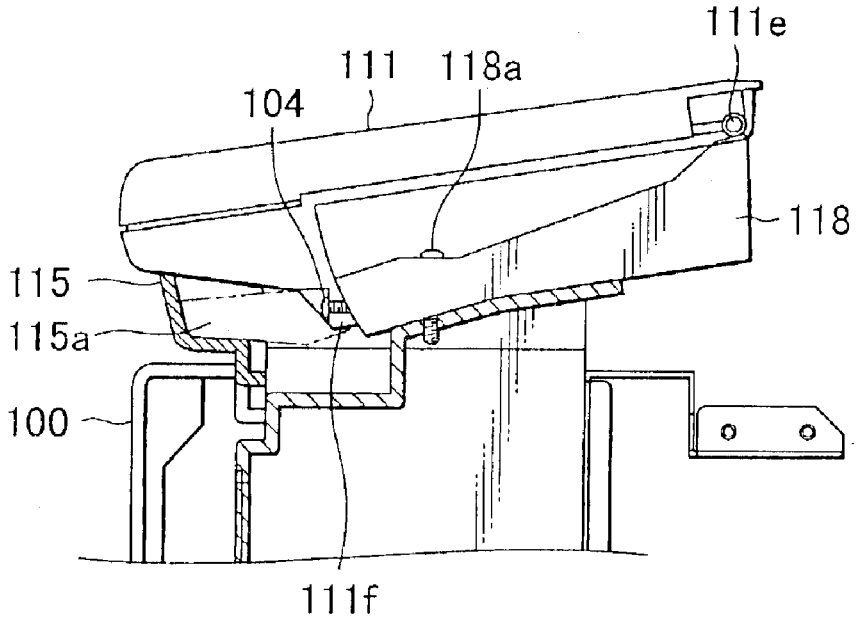

Subsequently, as shown in FIGS. 6A and 7A, when the operating surface unit 111 is located on the upper side, an angle $\alpha$ formed by a horizontal plane H and the operating surface of the operating surface unit 111 is 7°. The angle $\alpha$ is selected from the range of 5° to 10° with which the non-handicapped person can see the operating surface easily when a height h (see FIG. 1) of the operating surface of the operating surface unit 111 is 900 mm to 1,100 mm.

Figure 6B:
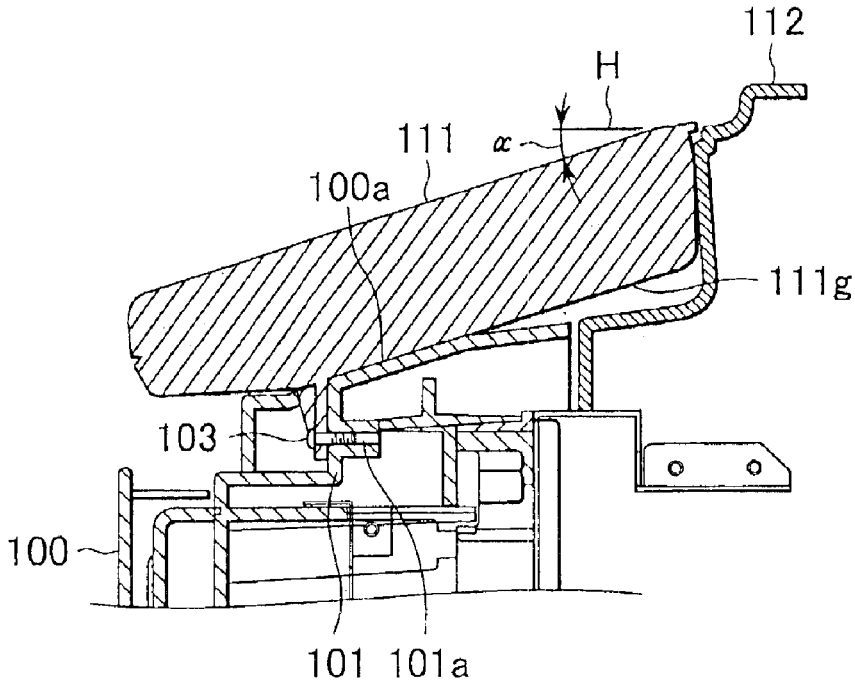
Figure 7B:
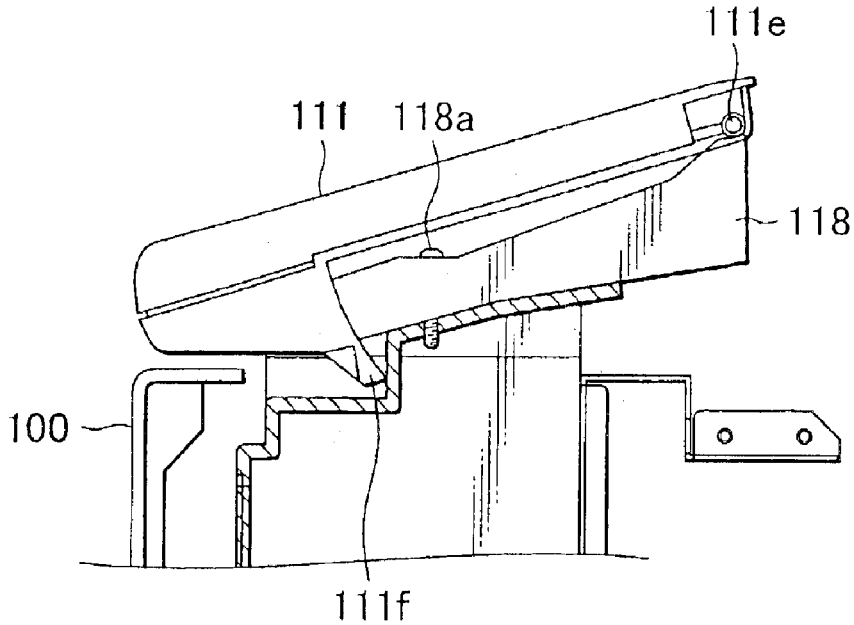

As shown in FIGS. 6B and 7B, when the operating surface unit 111 is located on the lower side, the angle $\alpha$ formed by the horizontal plane H and the operating surface of the operating surface unit 111 is 15°. The angle $\alpha$ is preferably within the range of 10° to 18° when the operating surface of the operating surface unit 111 has the height described above. If the angle $\alpha$ is less than 10°, a handicapped person in a wheelchair cannot see the operating surface easily; if it exceeds 18°, a non-handicapped person cannot see the operating surface easily.

Figure 8:
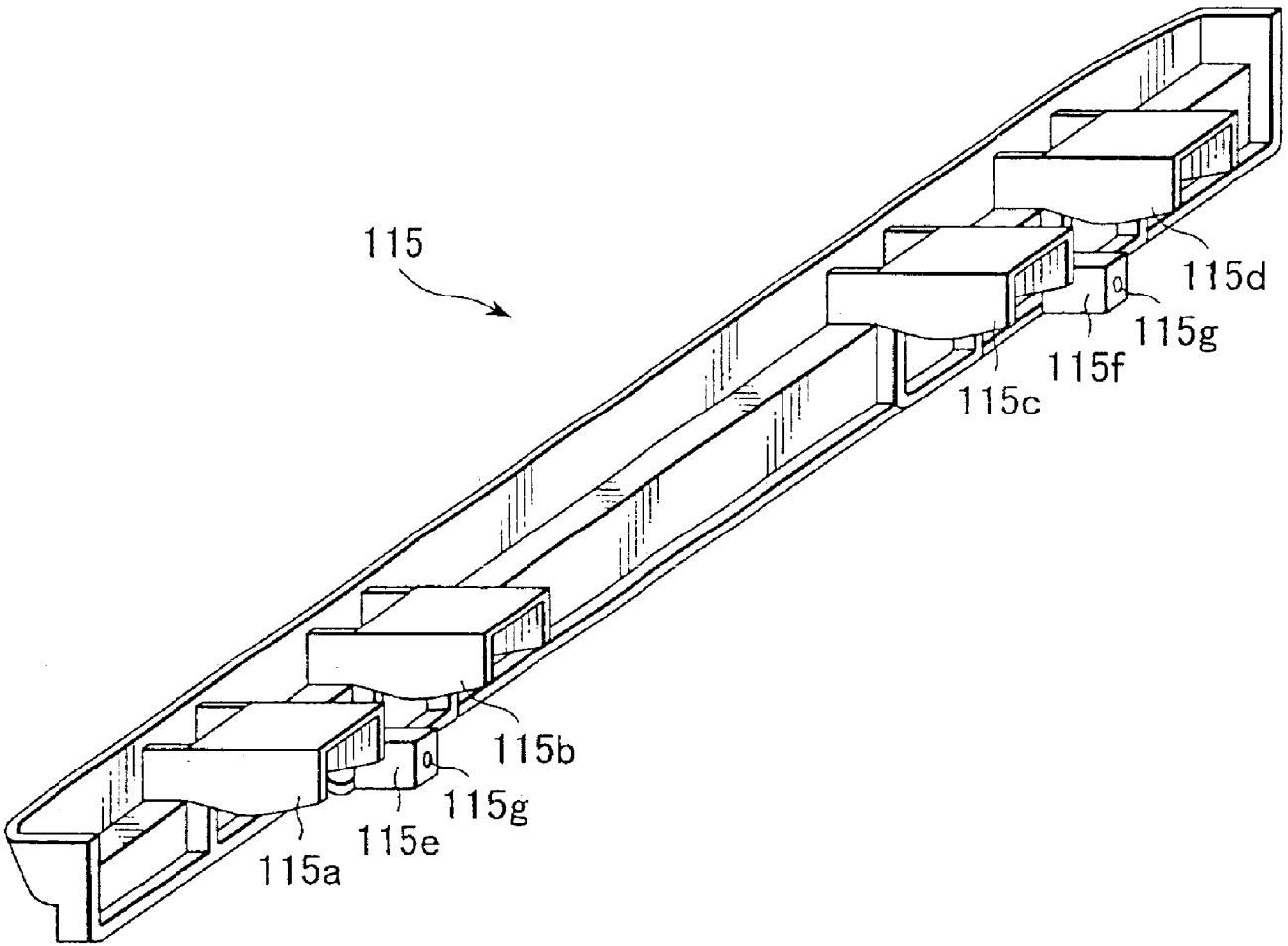
FIG. 8 is a perspective view of an angle holding member seen from the rear side.

The angle holding member 115 shown in FIG. 8 is inserted between the operating surface unit 111 and the apparatus main body 100 to maintain the operating surface unit 111 at the position of the upper side (angle $\alpha$=7°). The angle holding member 115 has the same length as that of the operating surface unit 111 and serves as a cover, so that when the operating surface unit 111 is raised, no gap is formed under it. The main body of the angle holding member 115 has a crank-shaped section, so it does not warp easily. The angle holding member 115 has four insertion pieces 115*a*, 115*b*, 115*c*, and 115*d* each having an inverted-U shaped cross section, and two locking target portions 115*e* and 115*f* each having an inverted-U shaped cross section similarly and a flat surface at its distal end. The flat surfaces at the distal ends of the locking target portions 115*e* and 115*f* respectively have screw holes 115*g*. In FIG. 8, the locking target portions 115*e* and 115*f* are hollow portions having open lower sides. The hollow portions have openings in the front surface of the apparatus main body 100, as shown in FIG. 3. Machine screws 103 can be mounted in and removed from the hollow portions by inserting a screwdriver through the openings.

Figure 9:
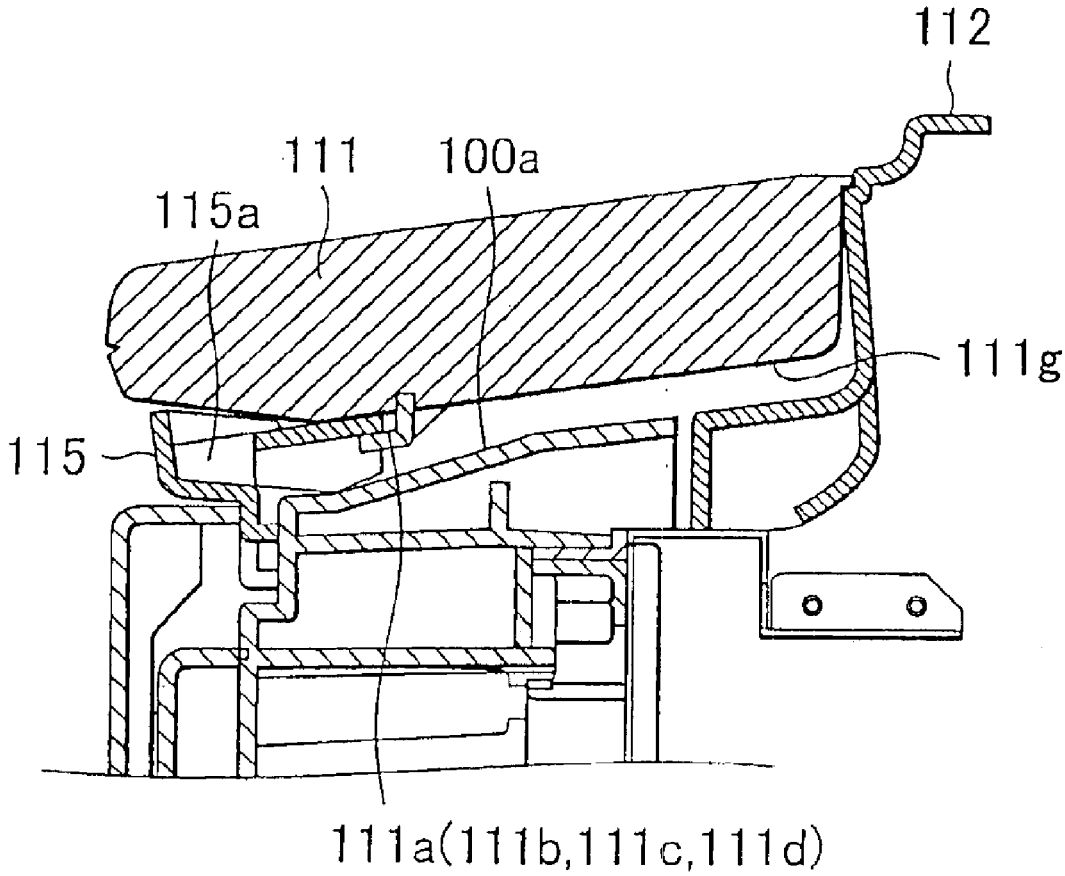
FIG. 9 is a sectional view with the angle holding member attached, which is taken at the position of the insertion piece.

As shown in FIG. 9, the operating surface unit 111 has a recess 111*a* in its lower surface. The distal end of the insertion piece 115*a* is inserted in the recess 111*a*, so the angle holding member 115 and operating surface unit 111 lock with each other. Although only the insertion piece 115*a* is shown in FIG. 9, the operating surface unit 111 also has recesses 111*b*, 111*c* and 111*d* (not shown) corresponding to the other three insertion pieces 115*b*, 115*c*, and 115*d*.

An operation procedure for setting the operating surface unit 111 to serve for the non-handicapped person, i.e., at the angle α of 7°, will be described.

With the operating surface unit 111 being removed from the apparatus main body as in FIG. 5, first, the operating surface unit 111 is fitted. This fitting operation is performed such that the pins 111*e* at the two ends are inserted at predetermined positions between the plate-like projections 112*a* and the upper-surface proximal ends 118*b* of the support brackets 118 from the direction of the arrow a of FIG. 5.

In this manner, the screw holes 111*f*' formed in the fixing projections 111*f* on the lower surface of the operating surface unit 111 (shown in FIGS. 4 and 7A) and female screw holes 118*c* at the distal end faces of the support brackets 118 are aligned to each other. Machine screws 104 are inserted, each through the two holes, and are fastened, so the operating surface unit 111 is supported by the apparatus main body.

Subsequently, as shown in FIG. 6A, when the angle holding member 115 is placed between the operating surface unit 111 and the apparatus main body 100, as shown in FIG. 9, the respective insertion pieces 115*a*, 115*b*, 115*c*, and 115*d* are fitted in the recesses 111*a*, 115*b*, 115*c*, and 115*d* of the operating surface unit 111, and the distal end of the locking target portion 115*e* abuts against a locking portion 101 of the apparatus main body 100. The locking portion 101 has a female screw hole 101*a*. The screw hole 115*g* of the locking target portion 115*e* is aligned to the female screw hole 101*a*, and the machine screw 103 is screwed into the two holes, thus fixing the angle holding member 115. Each machine screw 103 can be fastened by inserting a screwdriver through the opening (see FIG. 3) of the locking target portion 115*e* or 115*f* in the front surface of the apparatus main body 100, as described above.

With the above procedure, as shown in FIGS. 6A and 7A, the angle holding member 115 is fixed between the apparatus main body 100 and the operating surface unit 111, and the operating surface unit 111 is fixed to the operating section external unit 112. As the operating section external unit 112 is integral with the apparatus main body 100, the operating surface unit 111 is fixed to the apparatus main body 100.

When the operating surface unit 111 is located at the position (upper position) for the non-handicapped person shown in FIGS. 6A and 7B, a gap is formed between a lower surface 111*g* of the operating surface unit 111 and an opposing receiving surface 100*a* of the apparatus main body 100, as shown in FIG. 6A. In this case as well, a sufficiently large strength can be secured by the rigidity of the operating surface unit 111 itself and that of the angle holding member 115. Thus, the operating surface unit 111 will not flex or break.

The operating surface unit 111 is switched from the position for the non-handicapped person to the position (lower position) for the handicapped person in the following manner.

A screwdriver is inserted through the openings of the locking target portions 115*e* and 115*f* shown in FIG. 3, and the machine screws 103 are loosened and removed. When the two machine screws are removed, the angle holding member 115 is separated from the apparatus main body 100.

When the angle holding member 115 is pulled to the front side, the four insertion pieces 115*a*, 115*b*, 115*c*, and 115*d* disengage from the corresponding recesses 111*a*, 115*b*, 115*c*, and 115*d*, so that the angle holding member 115 can be removed from the apparatus main body 100.

When the angle holding member 115 is removed, the machine screws 104 (see FIG. 7A) fastened by the fixing projections 111*f* are exposed. The machine screws 104 are also successively removed by loosening them by the screwdriver.

With the above procedure, the operating surface unit 111 can pivot about the pins 111*e* as an axis. Thus, as shown in FIG. 6B, the distal end of the operating surface unit 111 is lowered. The lower surface 111*g* of the operating surface unit 111 and the receiving surface 100*a* of the apparatus main body 100 come into contact with each other and stop at the position shown in FIGS. 6B and 7B. At this time, a screw hole 111*j* (see FIG. 6A) of a projecting locking target portion 111*h* on the lower surface 111*g* of the operating surface unit 111 coincides with the female screw hole 101*a* of the locking portion 101. The corresponding machine screw 103 is inserted in the screw hole 111*j* and female screw hole 101*a*, and is fastened. Thus, the operating surface unit 111 is fixed at the lower position (the state with the angle α of 15°) to serve for the handicapped person.

As is apparent from the above arrangement, the same locking portion 101 of the apparatus main body 100 can serve for attaching and removing the angle holding member 115. Thus, the arrangement can be simplified.

When relocating the apparatus main body 100, it is done so by applying a force to the operating section external unit 112 by pushing or holding its two ends. Since the operating section external unit 112 is fixed to the apparatus main body 100, it is solid and will not be damaged during relocation. Since the operating surface unit 111 need not be touched at all, the apparatus main body 100 can be relocated without damaging the operating surface unit 111.

The operating section external unit 112 surrounds the three surfaces, i.e., the right and left surfaces and the rear surface, of the operating surface unit 111. Preferably, the operating section external unit 112 is always in contact with the operating surface unit 111 even when the operating surface unit 111 pivots as described above. In practice, however, it is difficult to always maintain the contact state through all of the three surfaces, but a gap may form. Then, a small foreign substance such as a clip may drop through the gap.

In view of this, according to the present invention, as shown in FIG. 2, a sealing member 116 formed of an elastic member is adhered to the contact portion of the operating surface unit 111 and operating section external unit 112. As the sealing member 116, a sheet made of foamed polyurethane, rubber, or the like can be used. Since the operating surface unit 111 pivots, the sealing member 116 comes into slidable contact with it. A groove is formed in one of the two opposing contact surfaces, and the sealing member 116 formed of the elastic member is fitted and fixed in the groove to project outside the groove. Even when that portion of the sealing member 116 which projects from the groove comes into press contact with the other contact surface and slides by the pivot motion, the gap between the two contact surfaces can be constantly sealed stably.

In the above embodiment, the operating section external unit 112 surrounds the operating surface unit 111 from the three directions, but alternatively can surround it from only the right and left ends. If the operating section is not long enough to reach from one end to the other end of the image forming apparatus, the operating section external unit 112 may be provided only at one end of the image forming apparatus.

The female screw hole 101*a* and recess 111*a* serving as a locking portion for fixing the angle holding member 115 are formed in the apparatus main body 100, but it suffices as far as they are formed in a portion fixed to the apparatus main body 100, e.g., in the operating section external unit 112. In the present invention, such locking portion and the operating section external unit 112 as a whole are called the apparatus main body.

Furthermore, in the embodiment of the present invention, two different angles can be obtained by attaching and removing one angle holding member 115. Alternatively, a plurality of angle holding members 115 may be prepared, and angle change in three or more steps can be realized.

What is claimed is:

1. An image forming apparatus having, on an upper surface of an apparatus main body, an operating section which can be divided into an operating surface unit in which an angle of an operating surface with respect to a horizontal plane can be changed, and an operating section external unit formed outside said operating surface unit and including at least an upper-surface corner end of said apparatus main body, comprising an angle holding member for holding the angle of the operating surface with respect to the horizontal plane, a plurality of locking portions formed on said apparatus main body, and a plurality of locking target portions which are formed on said angle holding member and said operating surface unit and which can respectively be locked by said plurality of locking portions, wherein either said locking target portion provided to said angle holding member or said locking target portion provided to said operating surface unit is selectively locked by said locking portion of said apparatus main body in order to support said operating surface unit with said apparatus main body such that said operating surface of said operating surface unit is held at a plurality of angles with respect to the horizontal plane.

2. An apparatus according to claim 1, wherein said angle holding member serves as a cover for covering a gap between said apparatus main body and said operating surface unit, and is detachably provided to said apparatus main body.

3. An apparatus according to claim 2, wherein engagement of said locking portions and said locking target portions is an arrangement of threadably engaging a machine screw in a female screw hole, and said machine screw can be mounted and detached through a front surface of said apparatus main body.

4. An apparatus according to claim 3, wherein when a height from a floor surface to the operating surface of said operating surface unit is 900 mm to 1,100 mm, an angle of the operating surface with respect to the horizontal plane is 5° to 10°.

5. An apparatus according to claim 3, wherein when a height from a floor surface to the operating surface of said operating surface unit is 900 mm to 1,100 mm, an angle of the operating surface with respect to the horizontal plane is 10° to 18°.

6. An apparatus according to claim 2, wherein a sealing member formed of an elastic member is adhered between said operating surface unit and said operating section external unit.

7. An apparatus according to claim 2, wherein when a height from a floor surface to the operating surface of said operating surface unit is 900 mm to 1,100 mm, an angle of the operating surface with respect to the horizontal plane is 5° to 10°.

8. An apparatus according to claim 2, wherein when a height from a floor surface to the operating surface of said operating surface unit is 900 mm to 1,100 mm, an angle of the operating surface with respect to the horizontal plane is 10° to 18°.

9. An apparatus according to claim 1, wherein engagement of said locking portions and said locking target portions is an arrangement of threadably engaging a machine screw in a female screw hole, and said machine screw can be mounted and detached through a front surface of said apparatus main body.

10. An apparatus according to claim 9, wherein a sealing member formed of an elastic member is adhered between said operating surface unit and said operating section external unit.

11. An apparatus according to claim 9, wherein when a height from a floor surface to the operating surface of said operating surface unit is 900 mm to 1,100 mm, an angle of the operating surface with respect to the horizontal plane is 5° to 10°.

12. An apparatus according to claim 9, wherein when a height from a floor surface to the operating surface of said operating surface unit is 900 mm to 1,100 mm, an angle of the operating surface with respect to the horizontal plane is 10° to 18°.

13. An apparatus according to claim 1, wherein a sealing member formed of an elastic member is adhered between said operating surface unit and said operating section external unit.

14. An apparatus according to claim 1, wherein when a height from a floor surface to the operating surface of said, operating surface unit is 900 mm to 1,100 mm, an angle of the operating surface with respect to the horizontal plane is 5° to 10°.

15. An apparatus according to claim 1, wherein when a height from a floor surface to the operating surface of said operating surface unit is 900 mm to 1,100 mm, an angle of the operating surface with respect to the horizontal plane is 10° to 18°.

* * * * *